US005542640A

United States Patent [19]

Tarozzi

[11] Patent Number: 5,542,640

[45] Date of Patent: Aug. 6, 1996

[54] EASEL

[75] Inventor: Richard A. Tarozzi, Gales Ferry, Conn.

[73] Assignee: Binney & Smith, Inc., Del.

[21] Appl. No.: 393,937

[22] Filed: Feb. 22, 1995

Related U.S. Application Data

[63] Continuation of Ser. No. 926,167, Aug. 5, 1992, Pat. No. 5,393,030.

[51] Int. Cl.[6] ..... A47B 97/04

[52] U.S. Cl. ..... 248/460; 248/462

[58] Field of Search ..... 248/441.1, 456, 248/460, 449, 461, 463, 165; 217/12 R, 13

[56] References Cited

U.S. PATENT DOCUMENTS

| | | | |
|---|---|---|---|
| D. 90,769 | 9/1933 | Kamen | D19/36 |
| D. 153,339 | 4/1949 | Deckinger | D74/1 |
| D. 252,758 | 8/1979 | Prall | D19/62 |
| 274,629 | 3/1883 | Merril . | |
| D. 279,489 | 7/1985 | Mak | D21/59 |
| D. 280,649 | 9/1985 | Iwabuchi | D21/64 |
| 281,591 | 7/1883 | Werner | 248/460 |
| D. 282,752 | 2/1986 | Olivetti | D19/26 |
| 310,481 | 1/1885 | Vail | 248/460 |
| D. 330,045 | 10/1992 | Dietterich et al. | D19/36 |
| D. 337,438 | 7/1993 | Levin | D6/311 |
| D. 346,287 | 4/1994 | Rosen | D6/429 |
| 384,171 | 6/1888 | Morris | 248/460 |
| 385,536 | 7/1888 | Van Wart | 248/449 |
| 396,362 | 1/1889 | Marks | 248/449 |
| 440,225 | 11/1890 | Gardner | 248/449 |
| 498,578 | 5/1893 | Schmirk | 248/449 |
| 518,544 | 4/1894 | Faint | 248/449 |
| 680,404 | 8/1901 | Woodbury et al. | 248/460 |
| 831,766 | 9/1906 | Bing | 248/461 |
| 1,625,647 | 4/1927 | Gillan | 248/463 |
| 1,782,118 | 11/1930 | Cahall | 248/449 |
| 2,032,872 | 3/1936 | Friedrichs | 248/195 |
| 2,143,368 | 1/1939 | Binder | 248/197 |
| 2,445,136 | 7/1948 | Egyed | 248/197 |
| 2,504,220 | 4/1950 | Ohlandt, Sr. | 248/195 |
| 2,518,877 | 8/1950 | Gauff | 248/197 |
| 2,526,527 | 10/1950 | Zander | 248/195 |
| 2,676,777 | 4/1954 | Moushon | 248/463 |
| 2,726,460 | 12/1955 | Jecmen | 35/62 |
| 2,918,732 | 12/1959 | Ortega | 35/62 |
| 3,095,665 | 7/1963 | Killen | 45/129 |
| 3,100,573 | 8/1963 | Cox | 211/177 |
| 3,145,966 | 8/1964 | Landon | 248/464 |
| 3,168,363 | 2/1965 | Monsour | 312/231 |
| 3,201,080 | 8/1965 | Rose | 248/460 |
| 3,202,741 | 8/1965 | Wilson | 312/231 |
| 3,226,077 | 12/1965 | Killen | 248/448 |
| 3,231,230 | 1/1966 | Mueller | 248/449 |
| 3,244,450 | 4/1966 | Boutin | 297/156 |
| 3,304,045 | 2/1967 | Bethoney | 248/451 |
| 3,352,616 | 11/1967 | Linger | 312/231 |

(List continued on next page.)

FOREIGN PATENT DOCUMENTS

| | | | |
|---|---|---|---|
| 70066/87 | 5/1990 | Australia | A47B 097/04 |
| 3931478 | 4/1991 | Germany | F16B 7/00 |
| 1396310 | 6/1975 | United Kingdom | A47B 97/04 |

OTHER PUBLICATIONS

Photocopy of the box and the assembly instructions for the Sesame Street My First Easel, Avalon Industries, Inc., Division of Craft House Corporation, Toledo, Ohio ®1984, ®1986, ®1991 Children's Television Workshop.

*Primary Examiner*—Karen J. Chotkowski
*Assistant Examiner*—Gwendolyn Wrenn-Baxter
*Attorney, Agent, or Firm*—Leydig, Voit & Mayer, Ltd.

[57] ABSTRACT

A device for providing support for drawing media is provided. The device has a first support member, a second support member and one panel having a drawing face. The panel is supported by the first support member and the second support member. The panel has a drawing face oriented upwardly at an angle to the horizontal. The device can include a supply tray for storing drawing supplies. The device can also include a second panel having a drawing face.

49 Claims, 6 Drawing Sheets

U.S. PATENT DOCUMENTS

| | | | |
|---|---|---|---|
| 3,368,786 | 2/1968 | Bulman | 248/455 |
| 3,467,259 | 9/1969 | Silver | 211/74 |
| 3,512,745 | 5/1970 | Gress | 248/449 |
| 3,599,925 | 8/1971 | Dubler | 248/452 |
| 3,669,227 | 6/1972 | Alford | 190/11 |
| 3,715,097 | 2/1973 | Kalajian | 248/449 |
| 3,799,488 | 3/1974 | Sena | 248/452 |
| 3,809,354 | 5/1974 | Phifer | 248/449 |
| 3,926,398 | 12/1975 | Vincent | 248/448 |
| 3,954,314 | 5/1976 | Crawford | 312/231 |
| 3,980,267 | 9/1976 | Palmer | 248/463 |
| 4,042,203 | 8/1977 | Warkentin | 248/449 |
| 4,109,892 | 8/1978 | Hartung | 248/449 |
| 4,134,614 | 1/1979 | Fielding, Sr. | 297/156 |
| 4,165,856 | 8/1979 | Wiseheart | 248/449 |
| 4,260,124 | 4/1981 | Heilman | 248/449 |
| 4,294,348 | 10/1981 | Hastings | 206/1.7 |
| 4,372,630 | 2/1983 | Fuhri | 312/231 |
| 4,453,470 | 6/1984 | Capella | 108/26 |
| 4,544,123 | 10/1985 | Peacock | 248/460 |
| 4,610,414 | 9/1986 | Schuck | 248/449 |
| 4,627,592 | 12/1986 | Stillwell | 248/465 |
| 4,702,638 | 10/1987 | Zalesal | 403/403 |
| 4,714,224 | 12/1987 | Calmes | 248/465 |
| 4,717,109 | 1/1988 | Johnston | 248/441.1 |
| 4,826,125 | 5/1989 | Kelley | 248/463 |
| 4,856,749 | 8/1989 | Habermann | 248/448 |
| 4,925,147 | 5/1990 | Potter | 248/463 |
| 4,971,284 | 11/1990 | Curry | 248/460 |
| 5,004,204 | 4/1991 | Cook | 248/449 |
| 5,005,795 | 4/1991 | Holmgren | 248/449 |
| 5,088,678 | 2/1992 | Bitan | 248/460 |
| 5,125,613 | 6/1992 | Albee, Jr. et al. | 248/464 |
| 5,152,490 | 10/1992 | Deutsch | 248/452 |
| 5,219,142 | 6/1993 | Potter | 248/454 |
| 5,242,145 | 9/1993 | Linnell | 248/449 |
| 5,273,248 | 12/1993 | Grander | 248/460 |

EASEL

This is a continuation of application Ser. No. 07/926,167, filed on Aug. 5, 1992 now U.S. Pat. No. 5,393,030.

BACKGROUND OF THE INVENTION

1. Technical Field

The present invention is directed toward easels and more particularly toward a table top drawing easel.

2. Background Art

Easels for holding a canvas on which an artist is painting are old in the art and generally involve three elongated members joined at a common point at the top, two of the members being rigidly attached to each other and having a ledge upon which the painting is supported. The third member is attached by a means of a chain or rope between the two rigidly attached members in order to provide the proper inclination in which to paint. Easels being designed for the use of adults in a standing position are unsuitable for children.

Artwork performed by children is therefore typically performed with the drawing surface in a horizontal position, i.e. on a desk or a table. When children try to paint with wet materials such as paint and fingerpaints, their arms and shirtsleeves often contact the wet paint, soiling their clothes. Also drawing on a horizontal table is harder on the children's eyes and backs.

The present invention is directed toward overcoming one or more of the problems discussed above.

SUMMARY OF THE INVENTION

In one aspect of the present invention, a device for providing support for drawing media is provided. The device has a first support member, a second support member and one panel. The panel is supported by the first support member and the second support member. The panel further has a drawing face oriented upwardly at an angle to the horizontal.

In another aspect of the present invention, a device for providing support for drawing media is provided. The device has first and second support members which each have a bottom and a horizontal opening running generally parallel and near the bottom. The device further has one panel which is supported by the first and second support members. The panel has a drawing face oriented upwardly at an angle to the horizontal. Finally, the device has a tray for storing drawing supplies slidably fitted between the openings of the first and second support members.

In a preferred embodiment of this aspect of the invention, the drawing surface has one shelf which protrudes from the panel near the bottom of the drawing surface, whereby the drawing media can be supported.

In another preferred embodiment of this aspect of the invention, a paperclip is attached to the panel for providing support for the drawing media.

In a further preferred embodiment of this aspect of the invention, two panels are provided, each having a drawing surface oriented upwardly at an angle to the horizontal.

In another aspect of this invention, a device for providing support for drawing media is provided. The device has a support member and a panel comprising two drawing surfaces which are flexibly joined together. The panel is supported by the support member and the drawing surface is oriented upwardly at an angle to the horizontal.

It is an object of this invention to provide an orderly work area where supplies can be found.

It is an object of this invention to provide a means for holding the drawing media that can be readily operated by a small child.

It is an object of the invention to provide an easel which requires a minimum amount of space for storage.

It is an object of this invention to provide an easel which may be used when a wet painting is still hanging on the easel.

DESCRIPTION OF THE PREFERRED EMBODIMENT

Figure 1:
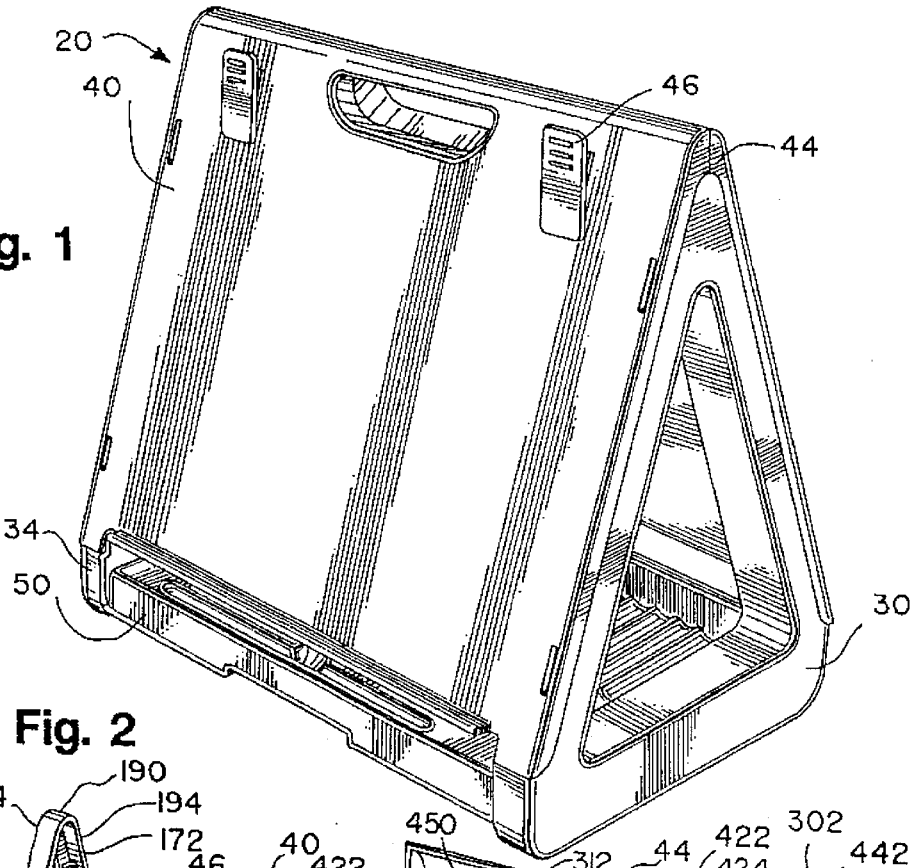
FIG. 1 is a perspective view of a first embodiment of the present invention.

An exemplary embodiment of-a device for providing support for drawing media, such as an easel 20 is shown generally in FIG. 1. While this embodiment is descriptive of the invention, the practice of the invention is not limited to the specific structure of this embodiment.

Figure 2:
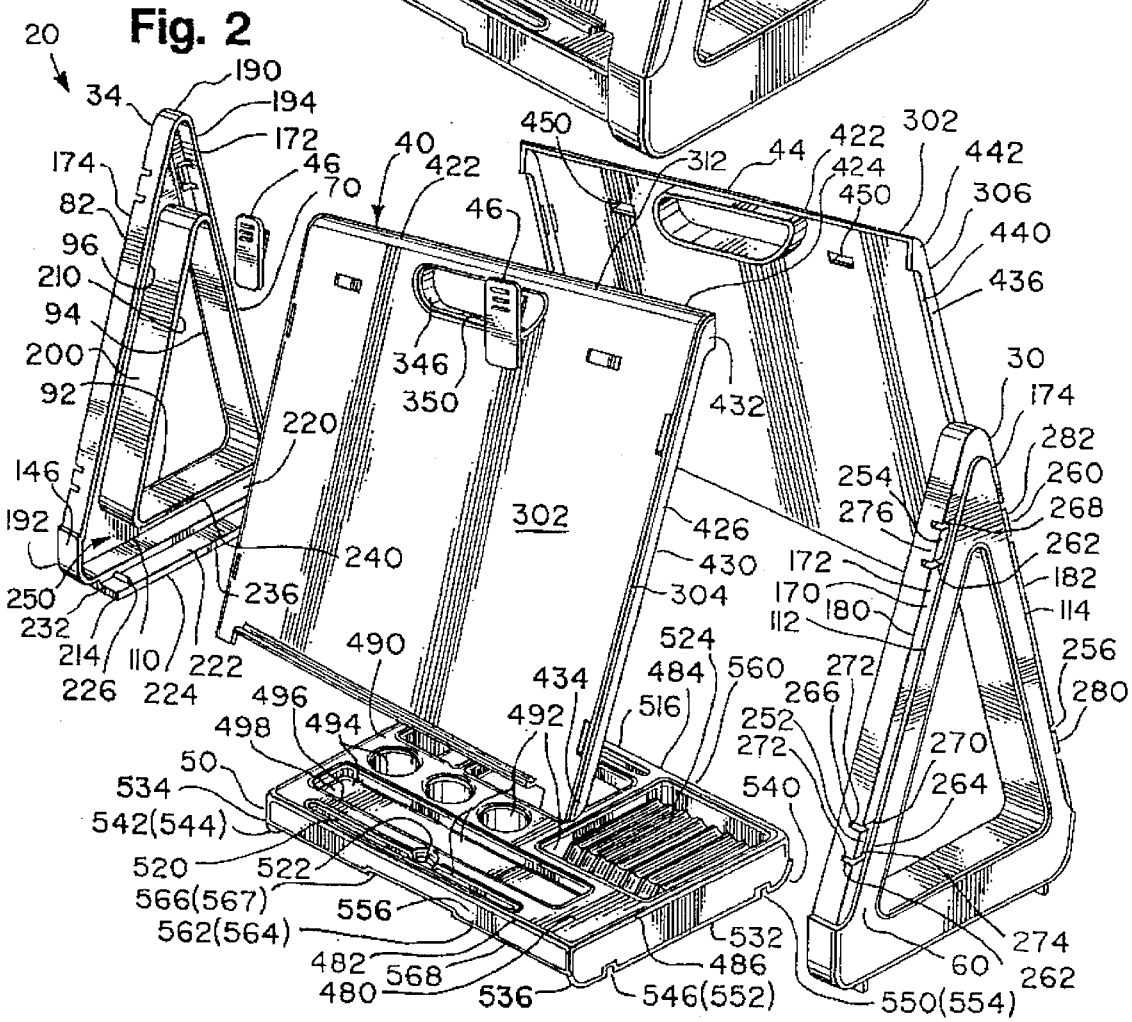
FIG. 2 is a perspective exploded view of the first embodiment of the present invention.

As shown in FIG. 2, the easel 20 consists of a first support member 30, a second support member 34, a first panel 40, a second panel 44, a clip 46, and a supply tray 50. However, the easel 20 could function with only the first support member 30 and the first panel 40. The easel 20 may be made of any suitable, pliable material, preferably a molded plastic.

Figure 3:
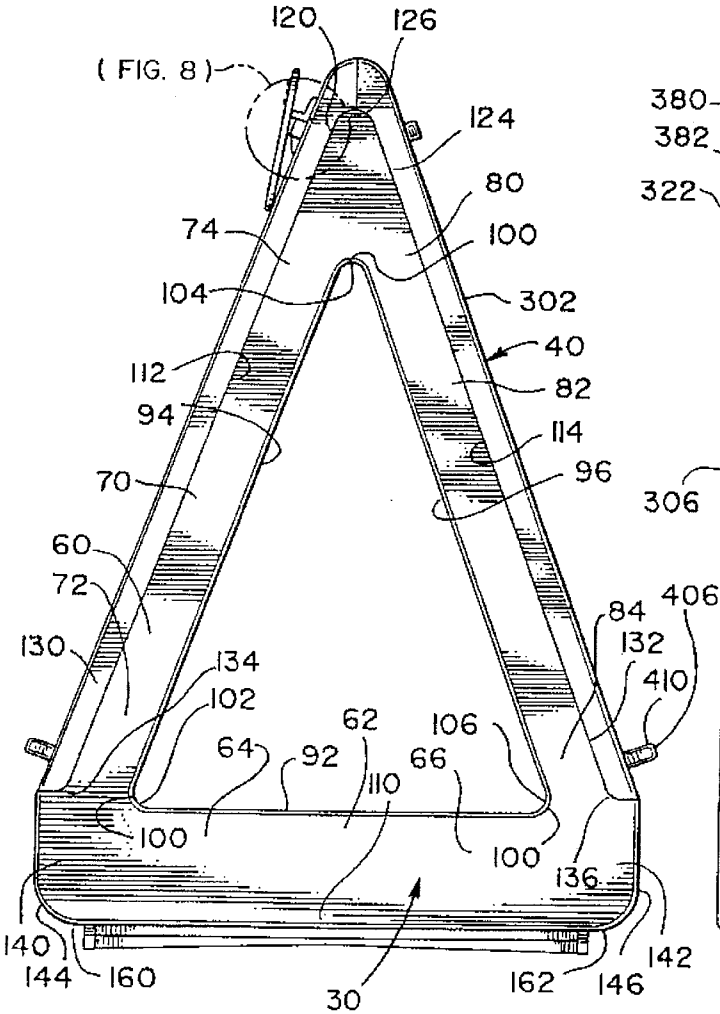
FIG. 3 is an end view of the present invention.

Referring to FIG. 3, the first support member 30 has a triangular planer surface 60. The triangular shape of the support member 30 is preferable for rigidity and to provide a properly inclined panel for drawing comfort. The triangularly shaped planer surface 60 consists of a horizontal planer portion 62 having left and right ends 64 and 66, respectively. A left inclined planer portion 70 is located at a lower end 72 adjoining the left end 64 of the horizontal portion 62 of the triangular planer surface 60. The left angular inclined face 70 has an upper end 74 which is attached to an upper end 80 of a right inclined planer portion 82. A lower end 84 of the right inclined portion 82 is attached to the right end 66 of the horizontal portion 62 of the triangular planer surface 60. The horizontal portion 62, left inclined portion 70 and right inclined portion 82 of the triangular planer surface 60 have inner edges 92, 94 and 96, respectively, disposed on the respective portions of the triangular planer surface 60. The inner edges 92, 94 and 96 have an arcuate contact 100 at their intersection points 102, 104 and 106, respectively. Parallel to and spaced outwardly from the inner edges of the horizontal portion 62, the left angular portion 70 and the right angular portion 82 of the triangular planer surface 60 have outer edges 110, 112 and 114 spaced apart and parallel to the respective inner edges. An upper end 120 of the left inclined outer edge 112 and an upper end 124 of the right inclined outer edge 114 tangentially meet with an upper diameter 126.

A lower end 130 of the left inclined outer edge 112 and a lower end 132 of the right inclined outer edge 114 intersect tangentially with left and right lower outer radii 134 and 136, respectively. The radii 134 and 136 extend horizontally to the left and right vertically disposed outer ends 140 and 142, respectively, of the horizontal planer portion 62. Outer edges 144 and 146 of outer ends 140 and 142 of the horizontal portion 62 of the triangular planer surface 60 meet tangentially with outer radii 160 and 162, respectively, and the lower edge 110 of the horizontal proportion 62 also meets tangentially with the outer radii 160 and 162.

Referring again to FIG. 2, recessed planer face 170 is parallel to and recessed from triangular planer surface 60. Recess surface 170 has a left recessed portion 172 which extends outwardly from the left outer edge 112 of the triangular planer surface 60 and a right recessed portion 174 which extends outwardly from the right outer edge 114. The left recessed portion 172 and the right recessed portion 174 meet at the top of the first support member 30.

The left recessed portion 172 has a left outer edge 180 which is parallel to and placed slightly outward from the left edge 112 of the triangular planer surface 60 and the right recessed portion 174 has a right outer edge 182 which is parallel to and spaced outwardly from the right edge 114 of the triangular planer surface.

Referring to the second support 34 which is identical to the first support 30, an outer support rib 190 extends inwardly from the outer edges 172 and 174 of the left and right recessed face as well as inwardly from the outer edges 110, 144 and 146 of the triangular planer surface 60 and perpendicularly to the triangular planer surface 60. The outer support rib 190 thereby extends around an entire periphery 192 of the first support member 30 providing rigidity for the planer faces 60. The outer support rib 190 has an inner edge 194 which is spaced from and parallel to the recessed face 170.

Still referring to the second support 34, an inner support rib 200 extends inwardly, perpendicular to the triangular planer surface 60 and parallel to the outer support rib 190, the rib 200 extends from the inner edge 92 of the horizontally disposed portion 62, the inner edge 94 of the left inclined planer portion 70, and the inner edge 96 of the right inclined planer portion 82 of the triangular planer surface 60. The inner support rib 200 provides additional structural support for the panel 40 and has an inner edge 210 which is parallel to and spaced inwardly from the inner edge 194 of the outer support rib 190.

A shelf 214 extends inwardly, parallel to and spaced downwardly from a lower horizontal portion 220 of the outer support rib 200. The shelf 214 has a top surface 222 and a bottom surface 224 parallel to, spaced from, and below the top surface 222. Left and right ribs 226 and 230, respectively, are located near left and right ends 232 and 234, respectively, of the top surface 222 of the shelf 220.

An outer edge 236 of the shelf 214 is co-planer with the inner edge 210 of the inner support rib 200 of the first support member 30. The top surface 222 of the shelf 214 is parallel to and spaced from a lower surface 240 of the inner support rib 200, thereby forming an opening or a channel 250. The channel provides a guide for sliding the tray 50 from storage position between the panels 40 and 44 to a use position extended outwardly from the panels 40 and 44.

Again referring to the first support member 30 as shown in FIG. 2, a lower left elongated slot 252 and an upper elongated slot 254 are located in the left recessed portion 172 of the recessed face 170 and are oriented parallel to and spaced outwardly from the left outer edge 112 of the planer triangular surface 60.

A lower right elongated slot 256 and an upper right elongated slot 260 are located in the right recessed portion 174 of the recessed face 170 and are oriented parallel to and spaced outwardly from the right outer edge 114 of the triangular planer surface 60.

A lower horizontal slot 262 extends outwardly from a lower end 264 of each of the four elongated slots 252, 254, 256 and 260 and an upper horizontal slot 266 extends outwardly from an upper end 270 of each of the slots 252, 254, 256 and 260. The upper and lower horizontal slots 266 and 262, respectively, extend inwardly from the recessed face 170 to an approximate midpoint 272 between the recessed face 170 and the inner edge 194 of the outer support rib 190. The lower and upper left elongated slots 252 and 254 and the lower and upper right elongated slots 256 and 260 in combination with their respective horizontal slots 262 and 266 form lower and upper left tabs 274 and 276, respectively, and lower and upper right tabs 280 and 282, respectively. The tabs 274, 276, 280 and 282 add flexibility to the slots 252, 254, 256 and 260, respectively.

The easel 20 may also include the second support member 34 which is preferably identical to the first support member 30. The easel 20 may be operable, however, with only the first support member 30.

Figure 4:
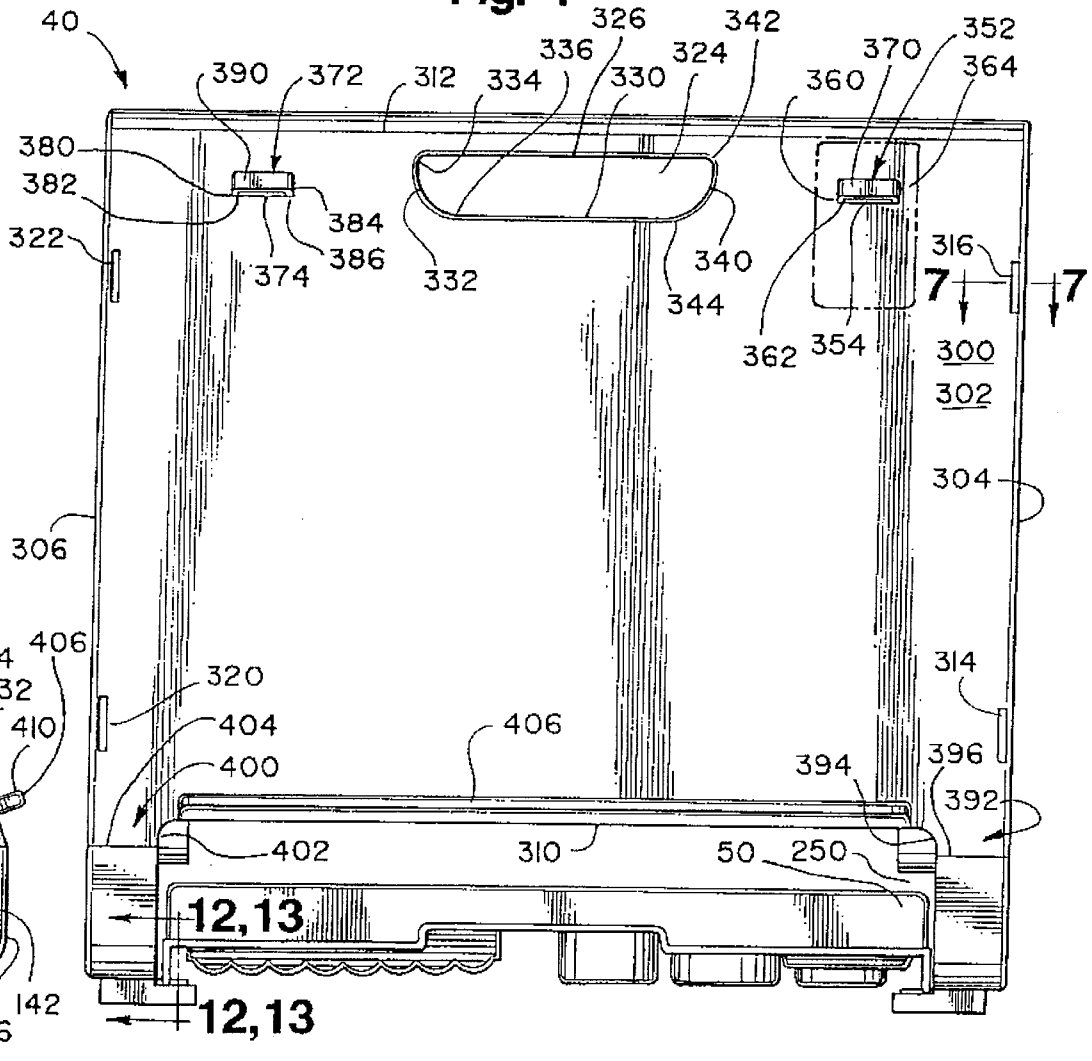
FIG. 4 is a side elevational view of the present invention.

Referring to FIG. 4, the first panel 40 has a rectangular first planer portion 300 with an outer face 302 on which drawing media can be mounted. The face 302 is bounded by a right edge 304 and a left edge 306 which is parallel to and spaced from the right edge 304. A bottom edge 310 of the outer face 302 is perpendicular to the left edge 306 and the right edge 304. Parallel to and spaced from the bottom edge 310 is a top edge 312.

A lower right vertically elongated slot 314 for securing the first panel 40 to the first support member 30, is located adjacent to the right edge 304 of the outer face 302. Directly above and spaced apart from the lower right slot 314 is a upper right vertically elongated slot 316. A lower left vertical elongated slot 320 is located adjacent to the left edge 306 of the outer face 302 and is vertically aligned with the lower right vertical elongated slot 310. An upper left vertically elongated slot is 322 located adjacent to the left edge of the 306 of the outer-face 302 of the panel 300 and is vertically aligned with the upper right vertically elongated slot 316.

An opening 324 sized for the insertion of a hand may be included to provide for transportation of the easel 20. The opening 324 is centrally located near the top edge 312 of the outer face 302 of the panel 300. The opening 324 has a top outer edge 326 which is parallel and adjacent the top edge 312 of the outer face 302. A bottom outer edge 330 of the opening 324 is parallel to and spaced below the outer top edge 326 of the outer face 302. A left arcuate edge 332 of the opening 324 is located between a left end 334 of the top outer edge 326 and the left end 336 of the bottom outer edge 330 of the opening 324. A right arcuate end 340 is located between a right end 342 of the top outer edge 326 and a right end 344 of the bottom outer portion 330 of the opening 324.

Referring to FIG. 2, an opening support rib 346 to provide comfort to the hand during transportation extends inwardly and perpendicularly from the bottom outer edge 330, the left arcuate end 332, the top outer edge 326 and the right arcuate end 340 of the opening 324. The opening support rib 346 has an inner edge 350 which is-spaced apart from the outer edges 330 and 326 of the opening 324 and which is located at a slight angle thereto.

Again referring to FIG. 4, a right loop 352 for attaching the clip 46 to the first panel 40 may be included and extends outwardly from the outer face 302 of the panel 300 near the top edge 312 of the outer face 302 and is equally spaced between the opening 324 and the right edge 304 of the outer face 302. The right loop 352 has a horizontally elongated slot 354 through the outer face 302 located between the opening 324 and the right edge 304. The loop 352 has an inner side 360 extending from the outer face 302 near an inner end 362 of the slot 354. All outer side 364 of the loop 352 extends outwardly and perpendicular from the outer face 302 near an outer end 366 of the slot 354. The loop 352 also has an horizontally elongated top 370 which is located between the inner side 360 and the outer side 364.

The panel 300 may also include has a left loop 372 for attaching another clip 46 to the first panel 40 which loop 372 protrudes outwardly from the outer face 302 near the top edge 312 of the outer face 302 equally spaced between the left arcuate end 332 of the opening 324 and the left edge 306 of the outer face 302. The left loop 372 has a horizontally elongated slot 374 in the outer face 302 equally spaced between the left edge 306 and the left arcuate end 332. Protruding perpendicular and outwardly from the outer face 302 is an outer side 380 located near an outer end 382 of the slot 374. All inner side 384 protrudes outwardly and perpendicular from the outer face 302 near an inner end 386 of the slot 374. The loop 372 has a top 390 which is located between the outer side 380 and the inner side 384.

The outer face 302 has a right extension 392 to allow for the entry of the tray 50 into the channel 250 which extension 392 extends downwardly from the bottom edge 310 near the right edge 304 of the outer face 302. The right extension has an inner edge 394 which is parallel to and spaced inwardly from the right edge 304. The right extension also has a bottom edge 396 which is parallel to and spaced below the bottom edge 310.

The outer face 302 of the panel 300 has a left extension 400 which extends downwardly from the bottom edge 310 of the outer face 302 near the left edge 306. The left extension has an inner edge 402 which is parallel to and spaced inwardly from the left edge 306. The left extension 400 has a bottom edge 404 which is parallel to and spaced below the bottom edge 310.

Figure 5:
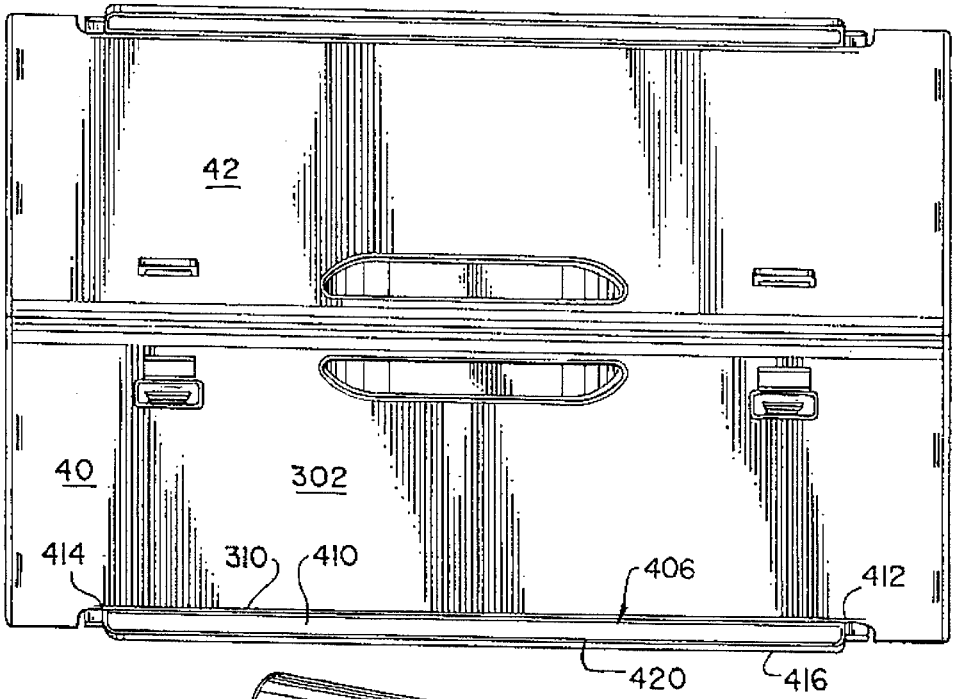
FIG. 5 is a top view of the present invention.

Referring to FIG. 3, the outer face 302 of the panel 40 may have a shelf 406 for supporting drawing media such as a piece of paper which shelf 406 extends outwardly and perpendicular to the outer face 302. The shelf 406 has a ledge 410 which is perpendicular to the outer face 302 and located along the bottom edge 310 of the outer face 302 as shown in FIG. 5. The ledge 410 has a right end 412 and a left end 414. The right end 412 and the left end 414 have an arcuate shape. The ledge 410 has a downwardly protruding lip 416 which extends from an outer edge 420 of the ledge 410. The lip 416 provides structural support for the ledge 410 and the lip 416 extends around the right end 412 and the left end 414 ending against the outer face 302.

Extending upwardly and inwardly from the top edge 312 of the outer face 302 as shown in FIG. 2 is an arcuate upper lip 422 having an inner edge 424 which is parallel to and spaced from the top edge 312. The inner edge 424 of the first panel 40 abuts the inner edge 424 of the second panel 44 providing a smooth shape with which to carry the easel 20 about the opening 324.

A right side lip 426 extends downwardly and perpendicular to the outer face 302 at the right edge 304 of the panel 40. The lip 426 assists in connecting the panel 40 to the first support member 30. The right side lip 426 has an inner edge 430 which is parallel to and spaced from the right edge 304. The right side lip 426 has an arcuate upper end 432 which conforms to the arcuate shape of the arcuate upper lip 422 and the arcuate configuration of the right support member 30. The right side lip 426 has an arcuate lower end 434 which conforms to the arcuate shape of the right support member 30.

Figure 6:
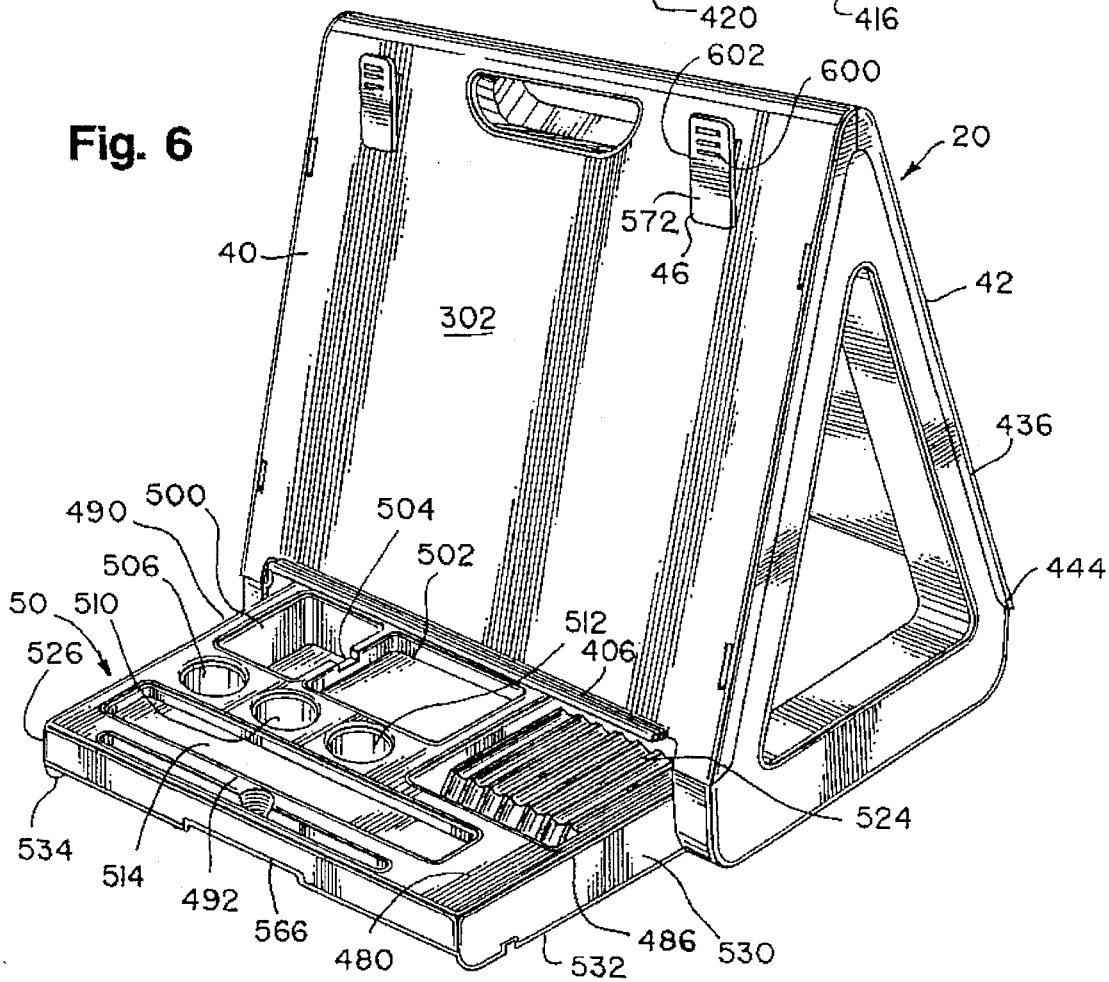
FIG. 6 is a perspective view of the present invention showing the tray at an extended position.

Referring to the second panel 44 which is identical to the first panel 40, the panel 40 has a left side lip 436 which is perpendicular to and spaced downwardly from the outer face 302 at the left edge 306 of the Outer face 302. The left side lip 436 has an inner edge 440 which is parallel to and spaced from the left edge 306. The left side lip 436 assists in connecting the panel 40 to the second support member 34 and the lip 436 has an arcuate upper end 442 which has an arcuate shape which conforms to the arcuate upper lip 422 and to the arcuate configuration of the left support member 34. The left side lip 436 has an arcuate lower end 444 as shown in FIG. 6 which has an arcuate shape which conforms to the shape of the left support member 34.

Figure 7:
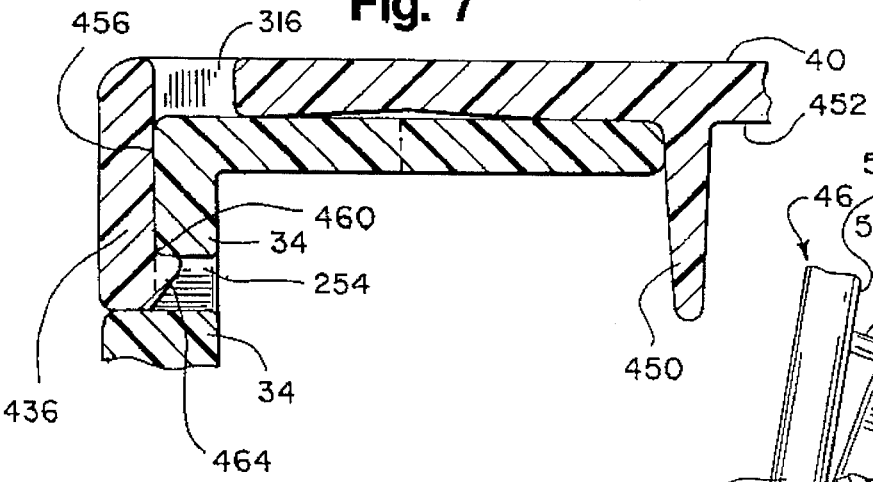
FIG. 7 is an enlarged fragmentary cross-sectional view taken along line 7—7 of FIG. 4.

Referring to FIG. 7, vertically elongated tabs 450 for securing the panel 40 to the support members 30 and 34 extend perpendicularly and outwardly from an inner face 452 of the panel 40. The tabs 450 are parallel to and spaced inwardly from the right side lip 426 and the left side lip 436. The tabs 450 are properly spaced from the right and left side lips 426 and 436, respectively, to provide a sliding fit to the outer inclined surfaces of the right and left support members 30 and 34, respectively. The tabs 450 are each located parallel to, spaced inwardly from, and centrally located with the lower right vertically oriented slot 314, the upper right vertically oriented slot 316, the lower left vertically oriented slot 320, and the upper left vertically oriented slot 322.

Protruding inwardly from right and left inner faces 454 and 456 at right and left inner edges 460 and 462 of the right and left side lips 426 and 436, respectively, are lips 464. The lips 464 snap into the elongated slots 252, 254,.256 and 260 securing the panel 40 to the support members 30 and 34. One of the lips 464 is located in vertical alignment with each of the four vertically elongated slots 314, 316, 320 and 322.

The second panel 44, as shown in FIG. 2, is preferably identical to the first panel 40.

Referring to FIG. 2, the supply tray 50 has a planer top 480 which has a front edge 482 and a rear edge 484 which is spaced from and parallel to the front edge 482. The top 480 also has a right edge 486 which is perpendicular to the front edge 482. A left edge 490 is parallel to and spaced from the right edge 486. Recessed pockets 492 extend downwardly from the top 480 of the supply tray 50. These pockets 492 have depending sidewalls 494 extending generally downwardly and perpendicularly to the top 480 of the supply tray 50. At a bottom edge 496 of the depending sidewalls 494 are pocket bottoms 498 which are parallel to and spaced downwardly from the top 480 of the supply tray 50.

Preferably each of the pockets 492 have a shape which generally conforms to the respective shape of a particular drawing supply item. For example, as shown in FIG. 6, a chalk erasure pocket 500 may be provided which has a generally rectangular shape to conform to the outside of a chalk erasure. Also a eight pack crayon box pocket 502 may be provided for storing an eight pack of crayons. A crayon box recess 504 in the top 480 of the supply tray 50 and the sidewalls 494 of the pocket 502 may be provided to ease the removal of drawing items such as the crayon box. Pockets 492 may also have cylindrical shape to hold cylindrical items such as finger paints as shown in first, second and third finger paint pockets 506, 510 and 512, respectively. The pockets 492 may also be used to hold a rectangular palette of water colors as shown in a rectangular water color pocket 514. The pockets 492 may also have an elongated shape for holding cylindrical writing instruments such as chalk or a paint brush as illustrated in chalk pocket 516 and paint brush pocket 520 as shown in FIG. 2. To access small elongated objects such as the paintbrush, a finger shaped recess 522 can be provided along the sidewall 494 of the pocket 520. The bottom 496 of the pocket 492 may have a contoured shaped 524 for holding elongated cylindrical objects such as the oversized crayons.

Again referring to FIG. 6, right and left sleds 526 and 530, respectively, extend downwardly from the right and left edges 486 and 490, respectively, and perpendicularly to the top 480. The sleds 526 and 530 are used to guide the tray 50 along the channels 250 of the support members 30 and 34. The right and left sleds 526 and 530, respectively, have bottom edges or runners 532 and 534, respectively, which are parallel to and spaced downward from the right and left edges 486 and 490, respectively.

Referring to FIG. 2, the right and left runners 532 and 534, respectively, have front and rear, right and left upwardly inclining arcuate portions 536, 540, 542 and 544, respectively. Front and rear, right and front and rear left slots 546, 550, 552 and 554, respectively, are located in the right and left runners 532 and 534, respectively. Front and rear lips 556 and 560, respectively, extend downwardly from the front and rear edges 482 and 484, respectively, of the top 480 of the supply tray 50. The front and rear lips 556 and 560 have front and rear bottom edges 562 and 564, respectively, which are parallel to and spaced downwardly from the front and rear edges 482 and 484 of the top 480 of the supply tray 50. The front and rear bottoms 562 and 564, respectively, are located closer to the top 480 of the supply tray 50, than the right and left runners 532 and 534, respectively.

Front and rear recesses 566 and 567, respectively, provide clearance for fingers to permit pulling the tray 50 from the storing position to the using position and are centrally located in the front and rear bottoms 562 and 564, respectively, of the supply tray 50. A rib 568 is located around the entire periphery of the supply tray 50 along the front and rear recessed areas 566 and 567, the front and rear bottoms 562 and 564, and the right and left runners 532 and 534.

Figure 8:
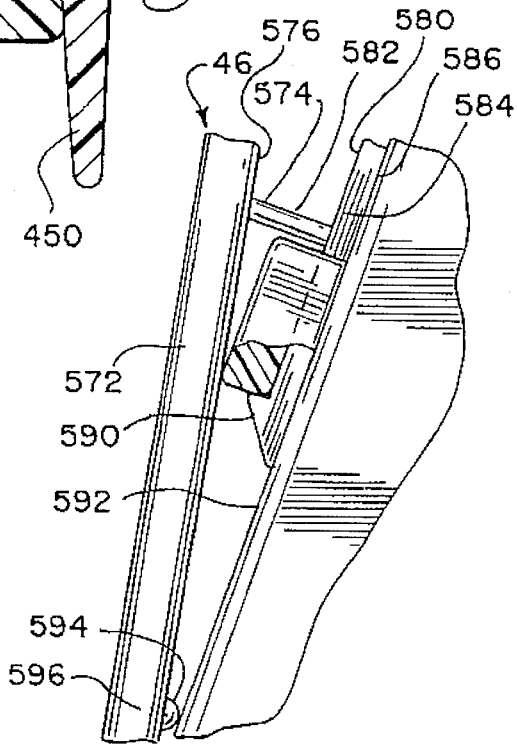
FIG. 8 is an enlarged area of FIG. 3 showing the construction of the clip and the clip support.

As shown in FIG. 1, a clip 46 can be used to hold the drawing media. Referring to FIG. 8, the clip 46 has a rectangular vertically elongated body 572. The clip 46 has a horizontally elongated stem 574 extending from an inner face 576 of the body 572. The stem 574 is attached to a base 580 at an end 582 of the stem 574 which is opposite the body 572. The base 580 has a generally rectangular shape with parallel inner and outer faces 584 and 586, respectively. A hook 590 for attaching the clip 46 to the panel 40 is attached to a lower end 592 of the inner face 584 of the base 580 of the clip 46.

The body 572 has a horizontally disposed lower rib 594 for attaching the drawing media to the panel 40 which rib 594 is located on the inner face 576 near a bottom 596 of the body 572. The stem 574 is so located between the body 572 and the base 580 such that the outer face 586 of the base 580 is co-planer with the rib 594. As shown in FIG. 6, horizontally disposed upper ribs 600 are located on an outer face 602 of the body 572 of the clip 46. The ribs 600 provide a rough surface to which a child may push with his fingers easily to release the drawing media.

In order to assemble the easel 20 as described above, a first panel 40 is placed on a table with the outer face 302 downward. The first support member 30 is placed on top of the first panel 40 with the inner edge 210 of the inner support rib 200 pointing downwardly. The lower left inclined slot 252 and the upper left inclined slot 254 are aligned with the lower right vertically elongated slot 314 and the upper right vertically elongated slot 316 of the panel 40, respectively. The inner edge 194 of the outer support rib 190 of the support member 30 is placed against the tab 450 of the panel 40. The panel 40 then is rotated until the triangular planer surface 60 of the support member 30 is in a vertical position. At this point the lips 464 engage the vertically elongated slots 314 and 316 securing the first support member 30 to the front panel 40. An identical procedure is performed to combine the second support member 34 to the rear panel 44.

To complete the assembly, the left recessed portion 174 of the recessed face 170 of the first and second support members 30 and 34, respectively, are aligned with the inner edges 440 of the left side lips 436 of the first and second panels 40 and 44, respectively. The panels 40 and 44 are then inserted into the support members 30 and 34. The lips 464 of the left side lips 436 snap into the lower and upper left vertically elongated slots 320 and 322, respectively, of the first and second panels 40 and 44, respectively. The tray 50 is then slid into the channels 250 in the first and second support members 30 and 34, respectively. The clips 46 are mounted onto the first and second panels 40 and 44 by sliding the base 580 of the clips 46 into the right and left slots 454 and 474, respectively. The hooks 590 snap against the right and left tops 370 and 390, respectively, of the right and left slots 354 and 374, respectively, thereby securing the clip 46 to the panels 40 and 44.

Figure 9:
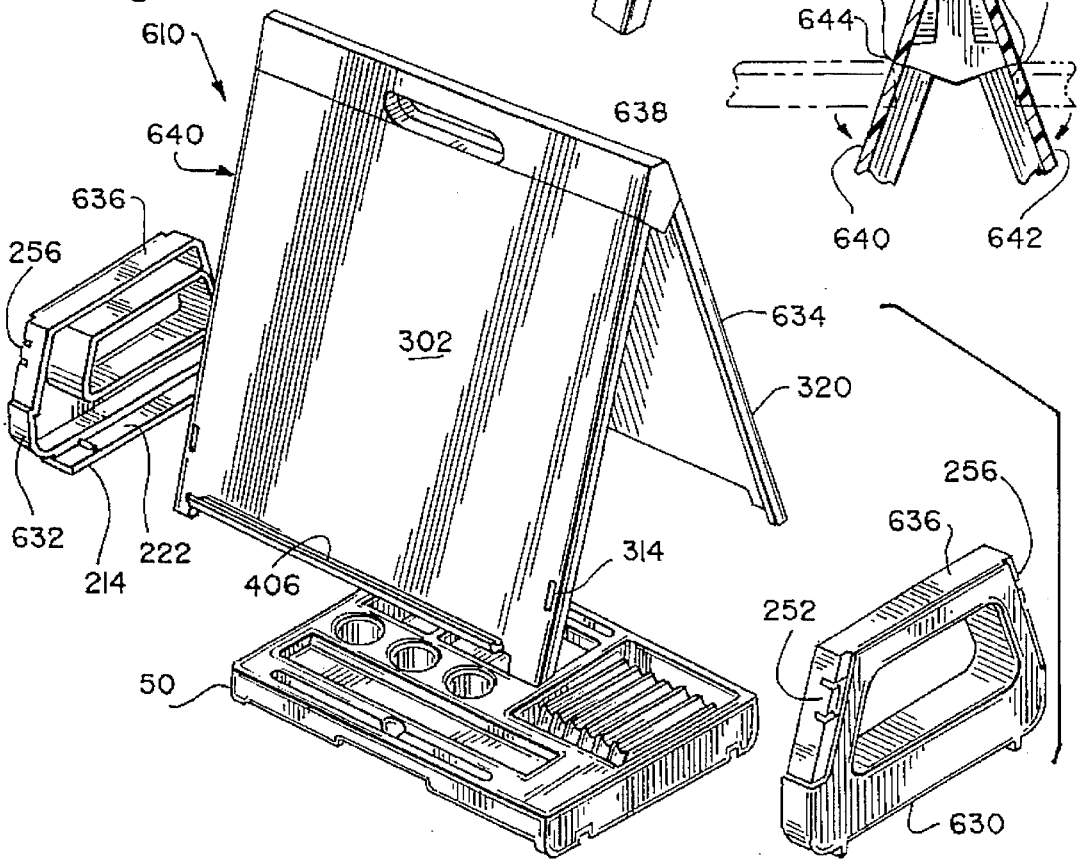
FIG. 9 is a perspective exploded view of a second embodiment of the present invention.

One of several possible alternate configurations of the present invention is an easel 610 as illustrated in FIG. 9. The easel 610 consists of a first support member 630, a second support member 632, a panel 634 and the supply tray 50.

The first and second support members, 630 and 632, respectively, are similar to the first and second support members 30 and 34 of the easel 20. The first support member 630 is identical to the second support member 632.

The second support member 632 has a top 636 which is parallel to and spaced below the top surface 222 of the shelf 214 at a location slightly above the lower left and right inclined slots 252 and 256, respectively. All features of the first and second support members 630 and 632 below the top 636 are identical to the support members 30 and 34 of the easel 20.

Figure 10:
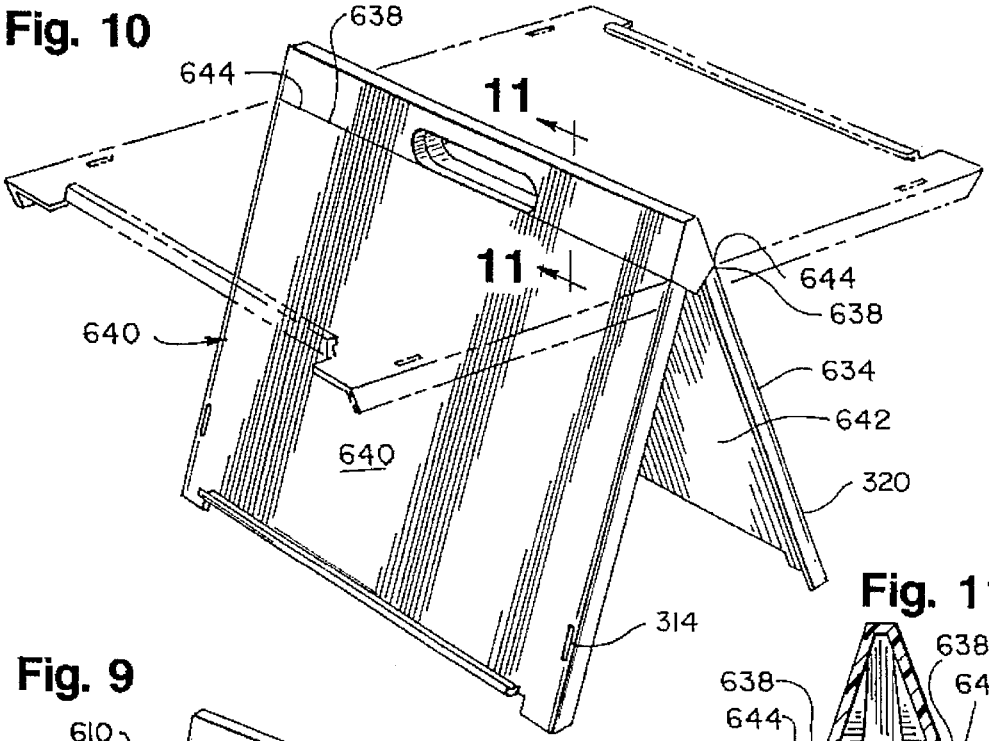
FIG. 10 is an perspective view of the panel showing movement of the panel about the living hinge.

Referring to FIG. 10, the panel 634 is similar to the combination of the first and second panels 40 and

44 of the easel 20 with the panels 40 and 44 in the assembled condition with the upper lip inner edges 424 0 of the panels 40 and 44 in the assembled configuration. Living hinges or flexible connections

Figure 11:
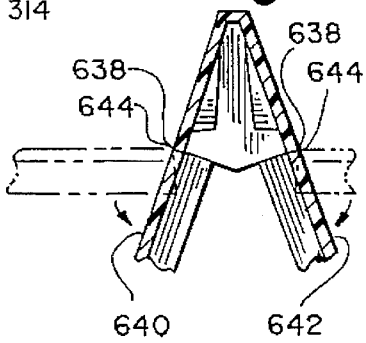
FIG. 11 is an enlarged fragmentary cross-sectional view taken along line 11—11 of FIG. 10.

638 as shown in FIGS. 10 and 11 combine a first panel portion 640 and a second panel portion 642 at upper edges 644 of the panel portion 640 and 642. The 5 living hinges 638 permit the panel portion 640 and 642 to pivot about the upper edges 644. The upper left and right inclined slots 254 and 260, respectively, are omitted from the easel 610.

Other than the aforementioned differences, the panel 634 of easel 610 is identical to the combination of the panels 40 and 44 of the easel 20. The tray 50 of the easel 610 is identical to the tray 50 of the easel 20.

As shown in FIG. 6, when utilizing the easel 20 or 610, drawing media such as paper is placed on an outer face 302 of the panels 40, 44 and 634. The paper is secured by a combination of clips 46 securing the top of the paper to the outer face 302 and a shelf 406 located at the bottom of the outer face 302 of the panels 40, 44 and 634. The clips 46 are operated by depressing against the ribs 602 on the outer face 600 of the clip 46 which rotates the clip providing a space between the rib 594 on the bottom 596 of the clip 46 and the outer face 302 of the panels 40, 44 and 634. Paper is then slid into the space provided and the clip 46 is released thereby securing the paper.

Figure 12:
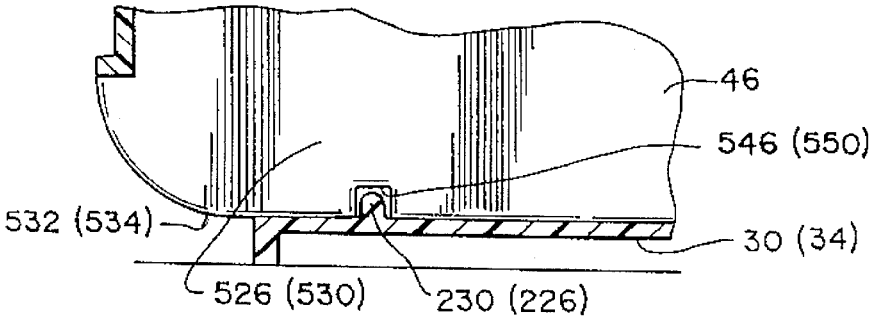
FIG. 12 is a cross-sectional view taken along line 12—12 of FIG. 4 with the tray in the closed

The tray as illustrated in FIGS. 1 and 6, is utilized by pulling the tray 50 outwardly by grasping at the front recessed areas 566 or the rear recessed areas 567. The tray 50 slides outwardly on the right and left runners 532 and 534 of the sleds 526 and 530. As shown in FIG. 12 in the storing position, the right front and rear slots 546 and 550, respectively, of the tray 50 are matingly engaged with the right and left ribs 230 and 226, respectively, of the first support member 30. The left front and rear slots 552 and 554, respectively, are matingly engaged with the left and front ribs 226 and 230, respectively, of the second support member 34. The tray 50 is thereby secured in position within the channels 250 of the support member 30 and 34 thereby protecting the contents of the tray.

Figure 13:
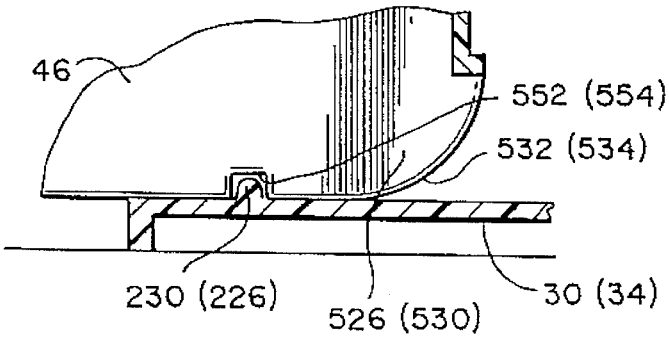
FIG. 13 is an enlarged fragmentary cross-sectional view taken along line 13—13 of FIG. 4 with the tray in open position.

Again referring to FIG. 6, when opening the tray, the child slightly lifts the front lip 556 of the tray 50 and pulls the tray 50 outwardly along the channels 250 of the support members 30 and 34 by pulling at the front recessed area 566. As shown in FIG. 13, when the tray 50 is almost fully extended, the right and left rear slots 550 and 554, respectively, engage the right and left ribs 230 and 226, respectively, of the support members 30 and 34 locking the tray 50 into a using position. After use the tray 50 may be pushed back into storing position.

Figure 14:
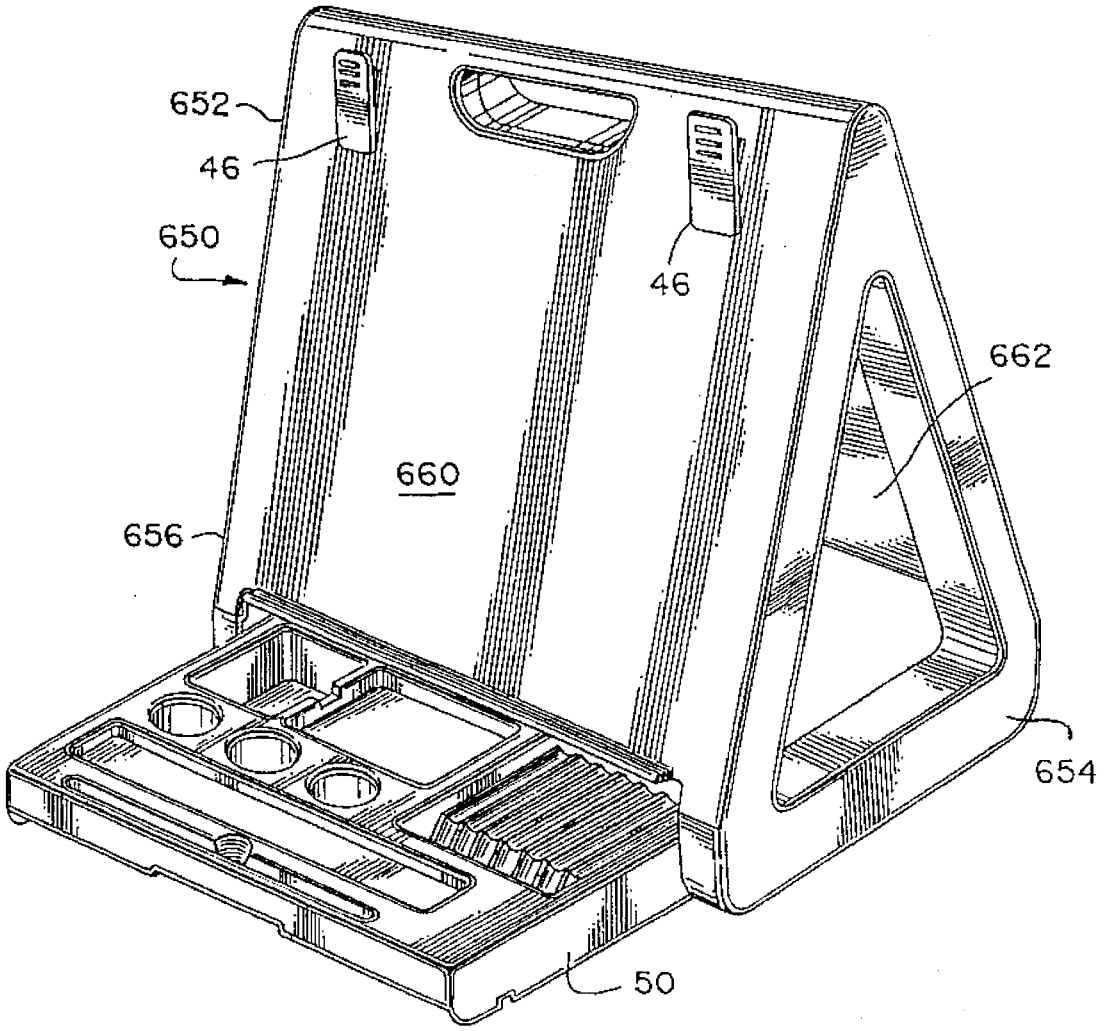
FIG. 14 is a perspective view of a third embodiment of the present invention showing the tray in an extended position.

Another alternate configuration of the present invention is an easel 650 as illustrated in FIG. 14. The easel 650 is similar to the easel 20 as shown in FIGS. 1–8 except that the first support member 30, the second support member 34, and the first panel 40 of the easel 10 are comprised of an integral housing 652 in the easel 650.

The housing 652 includes a first support portion 654 which is substantially identical to first support member 30, a second support portion 656 which is substantially identical to second support member 34, and a first panel portion 660 which is substantially identical to the first panel 40. Features of the easel 20 used solely to combine the support member 30 and 34 to the panels 40 and 42 such as tabs 274, 276, 280 and 282 as well as slots 252, 254, 256 and 260 are not required for easel 650. The other features of the easel 20 are incorporated into the easel 650.

The housing 652 of the easel 650 may also include a second panel portion 662 which is substantially identical to second panel 42. Clips 46 may be secured to the panel portion 660 and 662. The tray 50 is slidably fitted to the channels 250 of the support portions 654 and 656 of the housing 652. Except for the clips 46, the easel 650 need not be made of a pliable material and may be made of any suitable material. Molded plastic is a preferred material.

Note that the recessed pockets 492 of the tray 50 provide for an ample, neat, and orderly storing and using locations for all of the drawing supplies. Note that with the tray 50 being able to slide along the channels 250 to a locked using position, the supplies may be kept in their storage pocket 492 except when being held by the child. This system greatly reduces lost and damaged drawing supplies, as well as keeps the play area neat and orderly. Having the recessed pockets 492 molded for specific supply items, for instance, the chalk erasure pocket 500, the crayon box pocket 502 and the fingerpaints wells 506, 510 and 512, the location of each supply item is readily known and the absence of any item is readily apparent when the use of the easel 20 is completed.

The use of the spring clips 46 with ribs 602 to secure the fingers of the child while pushing the clip open makes the use of the clip particularly easy and suitable for small children.

The easy assembly and disassembly of panels 40 and 44 to the supports 30 and 34 to form the easel 20 permits for a compact arrangement of the components of the easel 20 in order to provide for a small, inexpensive compact package for shipment and storage prior to sale.

The use of two identical panels 40 and 44 provides for two work areas so that either two children may use the same easel, or a child may paint on one panel 40 and then rotate the easel 20 and draw a new picture on the second panel 44 while the first painting is drying. Also note that the ability for two children to utilize the same easel is facilitated by providing a through channel 250 in which the tray 50 may extend outwardly toward either the first panel 40 or the second panel 44 providing access of the supply tray 50 by either child.

Also note that the easel 20 is ideally suited for placing on a table with the drawing surfaces 302 of the panels 40 and 44 being inclined at an angle for comfortable drawings. Since all drawing supplies are located within the tray 50 inside the easel 20, table top space is kept to a minimum.

The use of an interlocked ribbed construction of the components of the easel 20 and the central upper location of a molded in handle on the panels 40 and 44 of the easel 20 provides for a light and durable easel 20 which may be easily carried by a small child.

While specific embodiments of the invention have been shown and described, it will be understood, of course, that the invention is not limited thereto since modifications may be made and other embodiments of the principles of this invention will occur to those skilled in the art to which this invention pertains. Therefore, it is contemplated by the appended claims to cover any such modifications and other embodiments as incorporate the features of this invention within the true spirit and scope of the following claims.

What is claimed is:

1. A children's table top easel for providing support for drawing media comprising:

a first support member;

a second support member;

at least one panel supported by the first and second support members, the panel having a drawing surface oriented upwardly at an angle to the horizontal; and, a supply tray movably and slidably engaging the first and second support members to permit the supply tray to move from a first position to a second position to facilitate access to the supply tray.

2. The invention as in claim 1 further comprising a second panel.

3. The invention as in claim 1 wherein the panel further comprises a shelf protruding outwardly from the drawing face near a bottom of the panel, whereby the drawing media can be supported.

4. The invention as in claim 1 wherein the first and second support members have a generally triangular shape.

5. The invention as in claim 1 wherein the supply tray further comprises recessed areas for storing drawing supplies.

6. The invention as in claim 5 wherein at least one of the recessed areas has a shape generally conforming to one of the drawing supplies.

7. The invention as in claim 1 further comprising a clip attached to the panel.

8. The invention as in claim 1 wherein the panel further comprises a handle.

9. The invention as in claim 1 wherein the panel has at least four edges, two edges being generally parallel.

10. The invention as in claim 9 wherein the panel has a rectangular configuration.

11. The invention as in claim 1 wherein the first support member, the second support member and the panel are integrally formed.

12. The invention as in claim 11 wherein said supply tray slidably engages the support members in a substantially horizontal plane.

13. The invention as in claim 11 wherein the panel further comprises a shelf protruding outwardly from the drawing surface near a bottom of the panel, whereby the drawing media can be supported.

14. The invention as in claim 11 wherein the first and second support members have a generally triangular shape.

15. The invention as in claim 11 wherein the supply tray further comprises recessed areas for storing drawing supplies.

16. The invention as in claim 15 wherein at least one of the recessed areas has a shape generally conforming to one of the drawing supplies.

17. The invention as in claim 11 wherein the support members have ribs and the tray has slots which mate with the ribs.

18. The invention as in claim 17 wherein the tray is held when the slots mate with the ribs.

19. The invention as in claim 18 wherein the tray is held in the first position when the slots mate with the ribs.

20. The invention as in claim 18 wherein the tray is held in the second position when the slots mate with the ribs.

21. The invention as in claim 11 further comprising a clip attached to the panel.

22. The invention as in claim 11 further comprising a handle.

23. The invention as in claim 11 wherein the panel has an opening.

24. The invention as in claim 23 wherein said opening is a handle.

25. The invention as in claim 11 wherein the panel has at least four edges, two edges being generally parallel.

26. The invention as in claim 25 wherein the panel has a rectangular configuration.

27. The invention as in claim 1 wherein said supply tray slidably engages the support members in a substantially horizontal plane.

28. The invention as in claim 1 wherein the support members have ribs and tray has slots which mate with the ribs.

29. The invention as in claim 28 wherein the tray is held when the slots mate with the ribs.

30. The invention as in claim 29 wherein the tray is held in the first position when the slots mate with the ribs.

31. The invention as in claim 29 wherein the tray is held in the second position when the slots mate with the ribs.

32. A children's table top easel for providing support for drawing media comprising:

a pair of support members;

a panel having two flexibly joined drawing surfaces supported by the support members such that the drawing surfaces are oriented upwardly; and, a supply tray movably and slidably engaging the support members wherein the support members are individual elements adapted to be secured to the panel when the easel is an assembled state.

33. The invention as in claim 32 further comprising a second support member.

34. The invention as in claim 33 wherein at least one drawing surface has at least four edges, two edges being generally parallel.

35. The invention as in claim 32 wherein the drawing surface further comprises at least one shelf, protruding ostensibly from the panel near the bottom of the drawing surface, whereby the drawing media can be supported.

36. The invention as in claim 32 wherein the supply tray further comprises recessed areas for storing drawing supplies.

37. The invention as in claim 32 wherein the support member includes and the supply tray includes runners having slots for mating with the ribs when the tray is suitably extended from the support member to hold the tray in a position for accessing the supplies.

38. The invention as in claim 32 further comprising at least one clip attached to the panel.

39. The invention as in claim 32 wherein the panel further comprises a handle.

40. A children's top easel for use with art supplies comprising:

a movable supply tray for storing art supplies; and, a housing for containing the supply tray having a containment area dimensioned to receive the supply tray and at least one drawing surface disposed in an upwardly inclined position, wherein the housing includes ribs within the containment area and the movable supply tray includes runners having slots for mating with the ribs of the housing.

41. An easel as in claim 40 wherein the housing includes two drawing surfaces disposed in upwardly inclined relation and the containment area is located in a substantially horizontal plane beneath the two drawing surfaces.

42. An easel as in claim 41 wherein the housing includes two connectable halves, each of the two connectable halves having one of the drawing surfaces.

43. An easel as in claim 42 wherein the two connectable halves are substantially symmetrical such that the drawing surfaces are disposed at substantially equal but opposite angles.

44. An easel as in claim 40 wherein the supply tray slidably engages the housing in a substantially horizontal plane.

45. An easel as in claim 40 wherein the drawing surface includes a shelf protruding outwardly from near a bottom of the drawing surface.

46. An easel as in claim 40 wherein the movable supply tray further includes recessed areas for storing art supplies.

47. An easel as in claim 40 wherein the slots on the runners mate with the ribs of the housing when the movable supply tray is extended from the containment area of the housing to hold the movable supply tray in a position for accessing the art supplies.

48. An easel as in claim 40 further comprising a clip attached to the housing for holding drawing media on the drawing surface.

49. An easel as in claim 40 further comprising a handle for transporting the easel.

* * * * *

UNITED STATES PATENT AND TRADEMARK OFFICE

CERTIFICATE OF CORRECTION

PATENT NO. : 5,542,640

DATED : August 6, 1996

INVENTOR(S) : Richard A. Tarozzi

It is certified that error appears in the above-indentified patent and that said Letters Patent is hereby corrected as shown below:

Title page,

Under [56] References Cited for U.S. Patent Documents:

"3,202,741" should be --3,202,471--

In the Specification:

In Column 2, line 49, "of-a" should be --of a--

In Column 6, line 31, "Outer" should be --outer--

In Column 9, line 6, "424 0" should be --424--

In Column 9, lines 8 and 9, the extra space after "connections" should be deleted to connect the two line of text.

In the Claims:

In claim 37, line 2, (Column 12, line 39) "includes and" should read --includes ribs and--

Signed and Sealed this

Nineteenth Day of November, 1996

Bruce Lehman

*Attest:*

BRUCE LEHMAN

*Attesting Officer*

*Commissioner of Patents and Trademarks*